US006328027B1

(12) United States Patent
Persyk et al.

(10) Patent No.: US 6,328,027 B1
(45) Date of Patent: Dec. 11, 2001

(54) METHOD FOR PRECISION CUTTING OF SOLUBLE SCINTILLATOR MATERIALS

(75) Inventors: Dennis E. Persyk, Hampshire, IL (US); Mark S. Andreaco, Knoxville, TN (US)

(73) Assignee: CTI, Inc., Knoxville, TN (US)

( * ) Notice: Subject to any disclaimer, the term of this patent is extended or adjusted under 35 U.S.C. 154(b) by 0 days.

(21) Appl. No.: 09/438,729

(22) Filed: Nov. 11, 1999

(51) Int. Cl.[7] ..... B28D 1/08
(52) U.S. Cl. ..... 125/21; 125/20
(58) Field of Search ..... 125/12, 20, 21; 451/60, 36, 37; 250/483.1, 367

(56) References Cited

U.S. PATENT DOCUMENTS 4,267,452 5/1981 Govaert .
5,704,105 1/1998 Venkataramani et al. .

FOREIGN PATENT DOCUMENTS 63-45005 * 2/1988 (JP) .
3-229188 * 10/1991 (JP) .

* cited by examiner

*Primary Examiner*—Derris H. Banks

(74) *Attorney, Agent, or Firm*—Pitts & Brittian, P.C.

(57) ABSTRACT

A method for precision cutting liquid soluble scintillator materials by an operator is disclosed, including the steps of providing a first run of a moving filament in operative proximity to cut the scintillator materials, concurrent with wetting at least the first run length of the moving filament with organic solvent, and engaging the wetted first run with the soluble scintillator materials for a time sufficient to create a kerf having cut surfaces with solvent thereon, with the kerf cut surfaces dissolved to reshape the kerf corners, and without the formation of surface hydrates. The wetting step is accompanied by providing a second run of the wetted filament in a reverse direction and engaging the scintillator materials. The first run and second run engaging steps are concurrent with tensioning the moving filament, producing kerfs through the scintillator materials, with organic solvent delivered onto kerf surfaces. The organic solvent, such as alcohol or organic-based solvent, dissolves the kerf surfaces and contiguous materials, softening the surfaces and producing precisely cut kerfs with gently radiused corners. Repetitive dicing, slitting, slotting and otherwise segmenting of the scintillator materials with the wetted moving filament creates precisely cut subunit scintillator materials with gently radiused corners. The method produces extremely precise kerfs in soluble scintillator materials with kerfs having gently radiused corners that are resistance to stress fractures, breakage, and cleavage during production and use of the scintillator materials.

15 Claims, 4 Drawing Sheets

METHOD FOR PRECISION CUTTING OF SOLUBLE SCINTILLATOR MATERIALS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF INVENTION

1. Field of Invention

The invention relates to a method for precision cutting of soluble scintillator materials. More specifically, the invention relates to a method for dicing, slitting, slotting, and segmenting soluble scintillator materials with liquid-wetted filaments.

2. Description of the Related Art

Prior art devices are well known for detecting the distribution of gamma-rays transmitted or emitted through objects to study the compositions or functions of the objects. The devices utilize scintillator crystals with techniques referred to as Emission Computed Tomography, which includes Single Photon Emission Computed Tomography (SPECT), that uses radiotracers which emit gamma-rays but do not emit positrons, and Positron Emission Tomography (PET), that uses radiotracers which emit positrons. The PET technique can determine, in-vivo, biochemical functions, on the injection of biochemical analog radiotracer molecules that emit positrons in a living body. The positrons annihilate with surrounding electrons in the subject body to produce a pair of gamma-rays, with detection of the gamma-rays by two opposed scintillator detectors allowing for the determination of the location and direction in space of a trajectory line defined by the trajectories of the gamma-rays. Tomographic reconstruction is then used to superpose the numerous trajectory lines obtained by surveying the subject with an array of scintillator detectors to image the distribution of radiotracer molecules in the living body.

Emission Computed Tomography systems employ a variety of geometric configurations of scintillator crystals in the gamma-ray detectors. The choice of a configuration is typically dictated by the manufacturer's desired system performance and cost. The detector design must be capable of providing accurate estimates of gamma-ray energy, position coordinates, and in the case of PET, coincidence time intervals to reconstruct an image of the distribution of the radiotracer for in vivo studies. Therefore, the detector design can require the cutting, dicing, shaping, slitting, slotting, and otherwise segmenting of scintillator crystals into a multitude of shapes, either rectangular or cylindrical, having side cuts, end cuts, slits and/or notches partially through the crystals.

Prior art systems for cutting and shaping scintillator crystals include metal band saws to cut alkali-halide scintillator crystals. Band saws create straight cuts with wide (0.030 inches to 0.060 inches) kerfs. The cutting action of the metal teeth create chipping during the onset, middle, and termination of the cut. In addition, metal teeth create sharp and/or jagged edges along a kerf that chip and may break away during use during the crystalline orientation of the scintillator materials. The tendency of jagged edges to break away leads to ease of cleavage along a crystallographic plane, producing scrap scintillator crystals or crystal materials that are unusable for precise determination of gamma-ray or positron energy and position of the trajectory of the gamma-rays. Use of metal band saws or slotting mill cutters create an edge break out that leads to a major source of scrap, unusable scintillator materials. An edge break out is the fracturing of the crystal that occurs as the saw blade is about to break out of the sawn kerf, with parting of the scintillator crystal into two pieces. The thin remaining unsawed piece can break off prematurely, with jagged edges rather than cleanly cut edges. Crystals composed of thallium doped sodium iodide (NaI(Tl)) are especially prone to chipping as NaI(Tl) edges are best chamfered or radiused to minimize chipping. An improved method of cutting and dicing scintillator crystals is needed that provides narrow width, straight kerfs, and gently radiused corners for each kerf cut by the method of cutting.

The SPECT detector systems utilize NaI(Tl) as the scintillator material. These systems can use large continuous slabs of NaI(Tl) optically coupled to a continuous light guide. The exception to continuous NaI(Tl) slab detector systems for SPECT imaging was disclosed by Govaert in U.S. Pat. No. 4,267,452. This detector system is unique as a SPECT detector in that it is segmented. The segmentation of the NaI(Tl) is similar to PET block detector designs which use an active light guide. (For clarification, detector light guides are of two general types: non-active light guides are composed of optical materials other than the scintillator; active light guides are composed of scintillator materials.) The segmentation of the scintillator materials results in a block of NaI(Tl) that is subdivided into elements that share a common light guide of active scintillator material, in other words the NaI(Tl) is not cut all the way through. A precise cutting method is needed to cut numerous kerfs and/or to dice, slot, scintillator material into subdivided scintillator elements and to produce precise partial cuts in scintillator elements that do not lead to breakage and segmentation of scintillator materials during use.

The prior art cutting methods of utilizing string saws wetted with water suffered from the drawback that generally rough cuts are possible while utilizing a water-wetted string saw. The cutting strings of the prior art are typically greater than 1.0 mm in thickness. The cut surfaces of the water-soluble scintillator (NaI(Tl)) form a white, surface, water-induced hydrate ($NaI.2H_20$) that must be ground away with additional cutting or finishing operations to mechanically remove the surface hydrate. NaI(Tl) is extremely hygroscopic and quickly forms a white hydrate on the kerf edges of the cut. The presence of the water-induced hydrate is undesirable because the surface coating prevents the escape of scintillator light through the hydrated scintillator surface. Additional cutting or finishing operations do not lead to precise cuts, and require additional preparation time for finishing of the scintillator materials.

Therefore, it is an object of the present invention to provide a method for precision cutting of soluble scintillator materials to precise configurations.

It is another object of the present invention to provide a method for precision cutting, dicing, slitting, slotting, and otherwise segmenting of soluble scintillator materials with a organic solvent wetted moving thin filament.

It is another object of the present invention to provide a method for precision cutting, dicing, slitting, slotting, and otherwise segmenting of soluble scintillator materials utilizing organic solvents to wet a moving thin filament to eliminate water induced hydrates on the cut surfaces of the scintillator materials.

It is another object of the present invention to provide a method for precision cutting, dicing, slitting, slotting, and otherwise segmenting of soluble scintillator materials with a plurality of organic solvent wetted moving thin filaments to increase production rates.

BRIEF SUMMARY OF INVENTION

A method for precision cutting, dicing, slitting, slotting, and otherwise segmenting of liquid soluble scintillator materials is disclosed, including a step of providing a first run of a moving filament in operative proximity to cut the liquid soluble scintillator materials, and providing a second run of the moving filament with the second run in a reverse direction of the first run. The providing steps are accomplished concurrently with wetting the moving filament with an organic solvent which dissolves the cut scintillator materials along the cut surface without the formation of water-induced surface hydrates. The wetting step is accompanied by an engaging step for placing the wetted moving filament in contact with the soluble scintillator materials for a time sufficient to create a kerf having exposed cut surfaces with organic solvent liquids thereon, and without the formation of water-induced hydrates on the cut surfaces. The engaging step applies the organic solvent from the wetted moving filament onto the cut surfaces of the kerfs during cutting, dicing, slitting, slotting, and otherwise segmenting of the soluble scintillator materials. The organic solvent liquid, such as alcohol or a organic-based solvent, once applied onto the cut surfaces of each kerf, softens the surfaces and produces kerfs having straight walls of narrow width, and edges having gently radiused corners. Additional concurrent steps include variably tensioning the wetted moving filament along the first run and along the second run of the moving filament, and positioning of the wetted first run and wetted second run to continue the process of cutting, dicing, slitting, slotting, and otherwise segmenting of the soluble scintillator materials. The organic solvent liquid, once applied onto the cut surfaces of each kerf, dissolves the exposed surfaces to reshape the soluble scintillator materials into kerfs having straight walls of narrow width and edges having gently radiused corners. The engaging and positioning steps are followed by repetitive dicing, slitting, slotting, and otherwise segmenting of the scintillator materials into separate subunit scintillator materials having gently radiused cut corners. The method steps produce extremely precise kerfs in soluble scintillator materials, and/or in subunits of soluble scintillator materials, with the precise kerfs having gently radiused corners at each corner of the cuts in the soluble scintillator materials.

The method steps can include providing a plurality of filaments that are in parallel orientation, the plurality of filaments can move at approximately similar speeds along a pathway between pulleys, or along a loop from the first run or supply pulleys, to the second run or takeup pulleys. The method steps can include a plurality of tensioning steps for adjusting tension on the filament during cutting, dicing, slitting, slotting, and otherwise segmenting of soluble scintillator materials, and can include a plurality of adjusting steps for repositioning the filaments in relation to the scintillator materials.

BRIEF DESCRIPTION OF SEVERAL VIEWS OF DRAWINGS

The above-mentioned objects and advantages of the present invention are readily apparent from the description of the invention contained herein, and by reference to the claims, read together with the drawings in which:

Figure 3A:
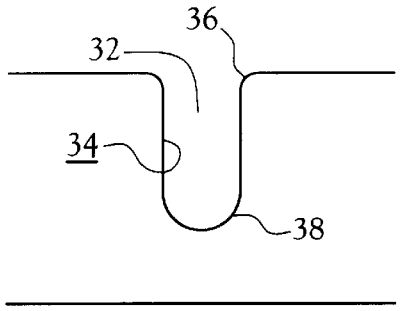
Figure 3B:
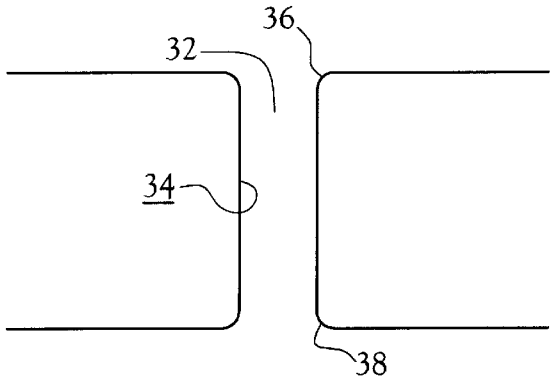
Figure 4A:
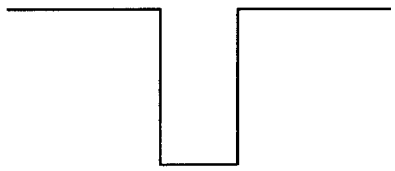
Fig.4a (PRIOR ART)
Figure 4B:
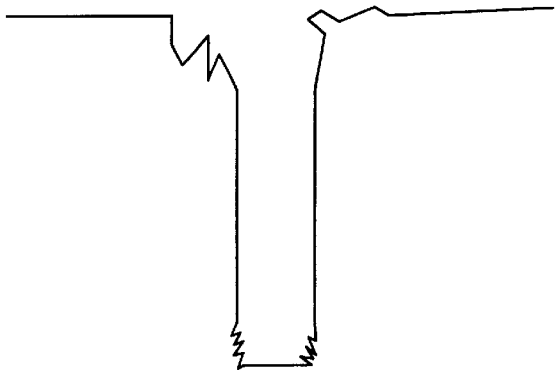
Fig.4b (PRIOR ART)
Figure 5:
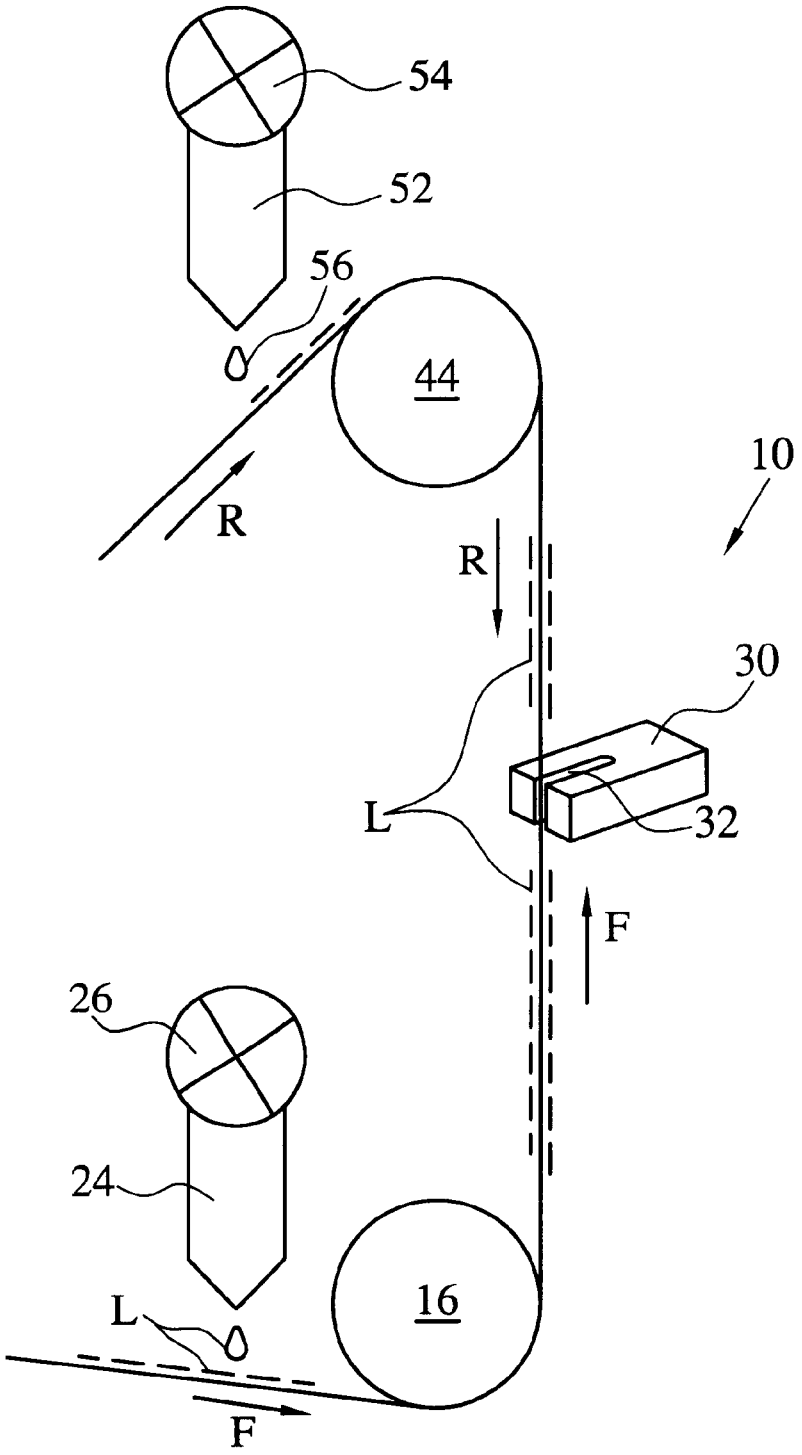

FIG. 3*a* is a cross-section of an example of a kerf made by the system controlled by the method for cutting and dicing, illustrating the straight walls of the kerf created by the present invention;

FIG. 3*b* is a detailed cross-section of the kerf of FIG. 3*a,* illustrating the gently radiused corners of the kerf created by the present invention;

FIG. 4*a* is a cross-section of an example illustrating the generally right-angled corners of the kerf created by the prior art method of cutting of scintillator crystals;

FIG. 4*b* is a detailed cross-section of the prior art kerf of FIG. 4*a,* illustrating the jagged and variable edges of the kerf created by the prior art; and FIG. 5 is a perspective view of the engaging step of the organic solvent wetted filament cutting into liquid soluble scintillator materials.

DETAILED DESCRIPTION OF THE INVENTION

Figure 1:
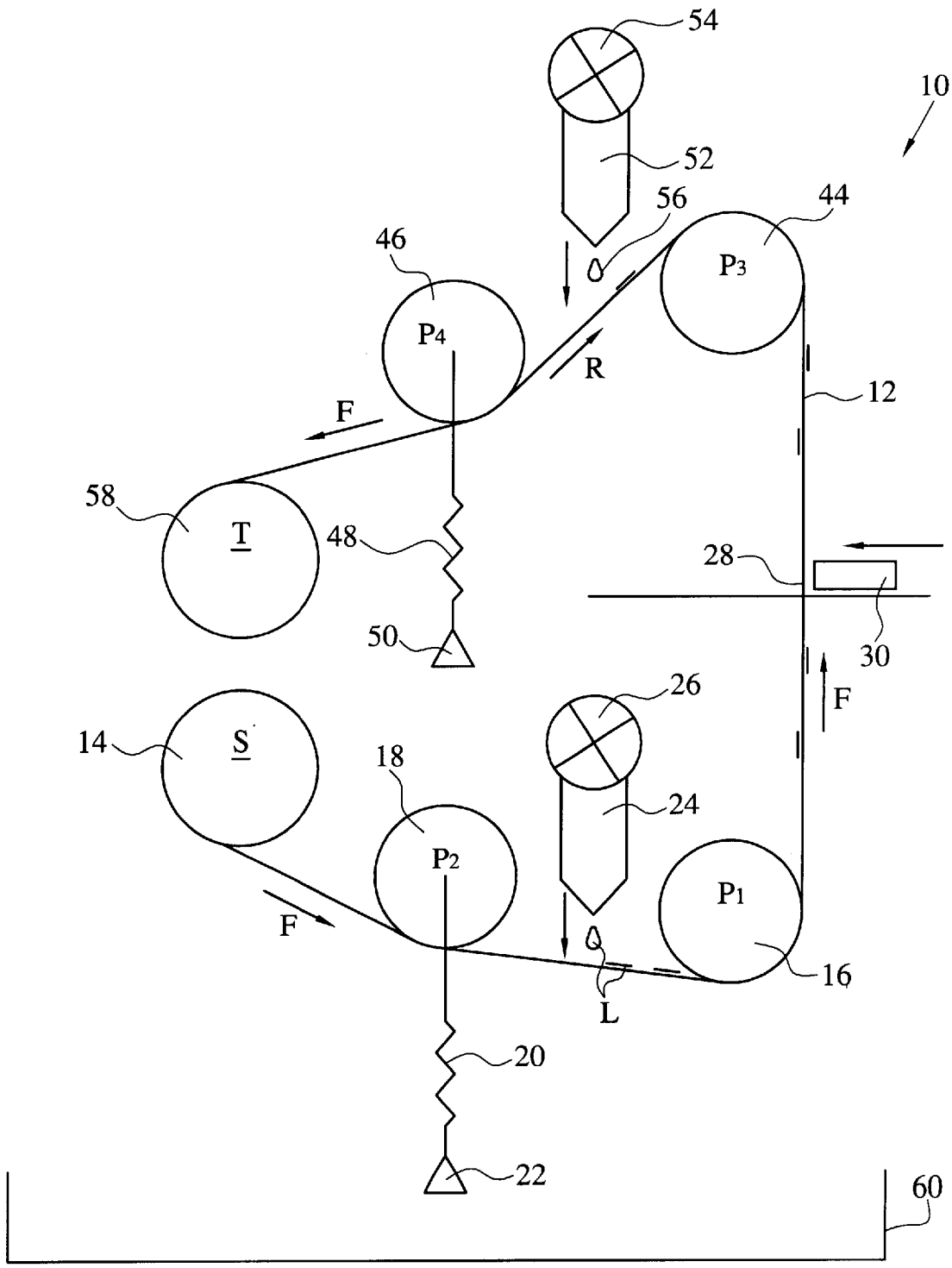
FIG. 1 is a side schematic view of a system for cutting and dicing of liquid soluble scintillator materials, the system controlled by method steps of the present invention.
Figure 2:
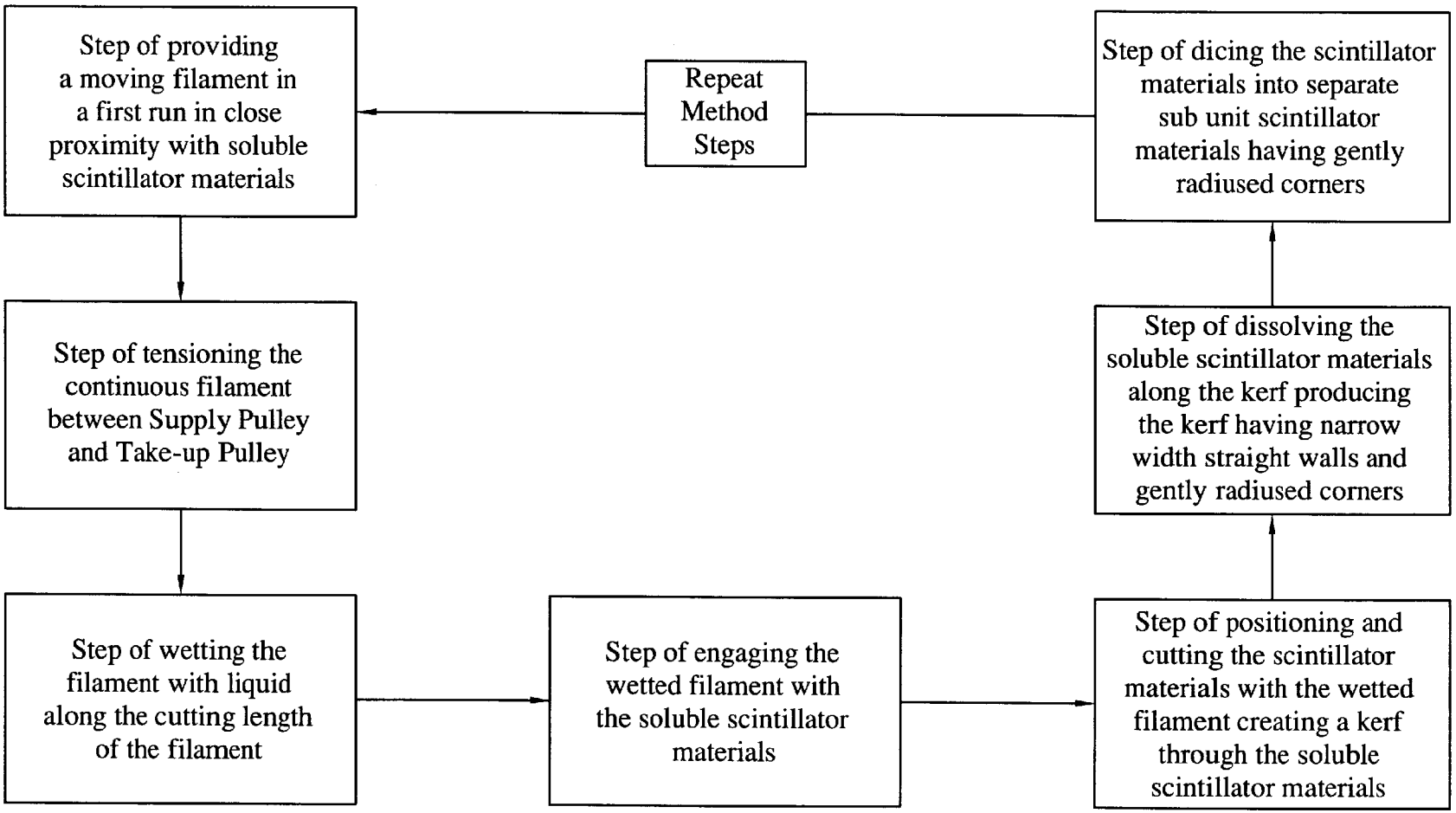
FIG. 2 is a block diagram of the method for cutting and dicing of liquid soluble scintillator materials of FIG. 1.

In accordance with the present invention, there is provided a method for precision cutting, dicing, slitting, slotting, and otherwise segmenting or pixellating liquid soluble scintillator materials, the method practiced with a system 10 capable of continuously operating the method as illustrated in FIGS. 1–5. Also described below and illustrated in FIG. 1, is a system for accomplishing the method for precision cutting and dicing of liquid soluble scintillator materials without the formation of water-induced surface hydrates on the cut surfaces of the scintillator materials.

The method comprises multiple steps including a step of providing a first run of a moving filament 12 (see FIG. 1) of approximately several hundred feet in length along a guided first run path, with the moving filament 12 in operative proximity to the liquid soluble scintillator materials. The first run of the moving filament 12 is tensioned between at least two guide pulleys 16, 44. Approximately several hundred feet of the filament 12 is attached around a first supply pulley 14, with the filament 12 wrapped around the first supply pulley 14. In an alternate embodiment, the filament 12 is formed in a continuous circulating loop (not shown), with continuous movement in one direction, or reciprocatingly reversing motion in alternating forward and reverse directions. The filament 12 is positioned in close proximity to, and moved to engage the liquid soluble scintillator materials 30 for a time sufficient to cause creation of a kerf 32 having exposed surfaces. The movement of the filament 12 is controlled by an operator, with the engaging step including reciprocatingly moving the first run of the filament 12 in a forward F direction while unwinding from the supply pulley 14 and winding around a takeup pulley 58. A second run of the filament 12 moves in a reverse R direction from the takeup pulley 58 and back toward the supply pulley 14. The reciprocating moving and engaging of filament 12 is essentially back and forth along its vertical axis in a repetitive sawing motion. An alternative action can include moving the filament 12 in a continuous circulating loop (not shown) as the filament 12 is positioned to move past and across the scintillator material 30. The rotation of the pulleys and the movement of the filament 12 is by any drive motor know to one skilled in the art of cutting materials.

The filament 12 is composed of thin flexible thread, or a wire or string of flexible material, such as cotton or a similar high-strength, flexible member. The filament 12 is tensioned between a plurality of pulleys along a first run distance between guide pulleys 16, 44. The initial or forward F direction of moving of the filament 12 is an unwinding direction from the first supply pulley 14, routing past and contacting a first tensioning pulley 18, then guiding around the first guide pulley 16, and along the first run distance from the first guide pulley 16 toward a cutting zone 28 where the moving filament 12 is directed in close proximity to the soluble scintillator materials 30. The first supply pulley 14 can have several hundred feet of filament 12 wrapped around the supply pulley 14, with the filament 12 unwinding partially or completely during the providing, moving, and engaging steps. The filament 12 contacts and moves past a first tensioning pulley 18 that is adjustable during a tensioning step by the operator.

The tensioning step provides variable tensioning of the moving filament 12 by to a tension adjustment means that includes a first tensioning pulley 18 having a spring 20 and support weight 22 attached to the first tensioning pulley 18 (see FIG. 1). The first tensioning pulley 18 can operate in conjunction with a second tensioning pulley 46 to provide variable tension on the filament 12 during the forward F movement of the filament 12, and during the reverse R or reciprocating movement of the filament 12. Each tensioning pulley 18, 46 is weighed by weights of approximately a few ounces to approximately several pounds depending on the type of filament 12 utilized in the system 10. The tensioning pulleys 18, 46 are attached to respective springs 20, 48, that cause the tension on the filament 12 to vary on the reciprocating moving filament 12. The cutting rate of the moving filament 12 utilized in the engaging and cutting steps can vary as the wetted moving filament 12 encounters variable grain boundaries within the soluble scintillator materials 30, as is common to NaI(Tl) materials. The springs 20, 48 assist in varying the tension on the wetted moving filament 12 as the rate of sawing and dissolving of soluble scintillator materials varies during the cutting, dissolving, and/or dicing steps. The varying tension applied during the tensioning step on the wetted moving filament 12 has the beneficial effect of maintaining during the cutting and dicing steps a straight cut through the soluble scintillator materials 30. The tension applied during the tensioning step is determined by the type of filament 12 used, whether cotton thread, string, or synthetic filament, and by type of scintillator materials being cut. The tension can range from approximately five pounds to approximately fifty pounds, as determined by one skilled in the art to maintain straight cuts through scintillator materials 30 during cutting and dicing.

During the wetting step, as moving filament 12 is routed around tensioning pulley 18, the filament 12 is moved past a first liquid dispensing means that includes a first dispensing dripper 24 having an adjustable valve 26. First dispensing dripper 24 dispenses an organic solvent liquid (L) either continuously or intermittently onto moving filament 12. The amount of organic solvent liquid L dispensed onto the wetted moving filament 12 is adjustable by the operator manipulating adjustable valve 26 integral with first dispensing dripper 24 (see FIG. 1 and FIG. 5). Wetting step dispenses organic-based solvent mixed with water, or non-aqueous alcohol-based liquid, such as alcohol, onto moving filament 12, coating filament 12 with organic solvent liquid L while first guide pulley 16 guides filament 12 to engage soluble scintillator materials 30 at a cutting zone 28 holding scintillator materials 30. While engaging the scintillator materials 30 for a sufficient time, wetted moving filament 12 delivers organic solvent liquid L onto the kerf 32 exposed wall 34 surfaces; therefore dissolving soluble scintillator materials 30 on and contiguous to exposed surfaces of the kerf 32, reshaping the surfaces and contiguous corners of the kerf 32, and limiting the formation of water-induced surface hydrates. The wetting step continues to dispense alcohol-based solvent and/or other organic-based solvent liquids onto the cut, exposed surfaces as the wetted moving filament 12 engages and cuts into the soluble scintillator materials 30. The dispensed organic solvent liquids L dissolve soluble scintillator materials on the surfaces of the kerf 32, creating short-term softening, separation into multiple portions, and reshaping of contiguous materials along kerf surface edges 36, forming gently radiused corners 38 for the entry and exit opening of kerf 32.

The engaging step continues concurrently with the steps of wetting and tensioning of the moving filament 12. The engaging step further includes moving the filament 12 past the cutting zone support 28 and along a second run of the filament 12 by guiding the filament 12 around a second guide pulley 44 on the takeup, or return side of the system 10. The filament 12 is routed past a second dispensing dripper 52, controlled by a second valve 54, which can apply additional alcohol-based organic solvent liquid L, and/or a different organic solvent liquid 56, applied during the reverse R movement of the filament 12 in the reciprocating direction back toward the cutting zone 28. When the filament 12 is moving in the forward F direction, the filament 12 continues past and over a second tensioning pulley 46 having an associated second spring 48 and second support weight 50. The forward F direction of the moving filament 12 is completed as it winds around the takeup pulley 58. An operator can control the frequency of the reciprocatingly reversal of changes of direction of the filament 12 movement, forward F to reverse R, reverse R to forward F, during each of the steps from the wetting and engaging steps to the cutting and dicing steps. The reverse R movement of the filament 12 is an unwinding from takeup pulley 58, routing the filament 12 past second tensioning pulley 46, guiding around second guide pulley 44, and past the cutting zone 28 for eventual winding back onto first supply pulley 14.

Concurrent with the steps of providing, wetting, engaging, and tensioning, a positioning step occurs that allows the wetted moving filament 12 to contact against the soluble scintillator materials 30. The positioning step allows an operator to adjust the horizontal distance between the wetted moving filament 12 and the soluble scintillator materials 30 positioned on the cutting zone 28 support. The positioning step can include repositioning the wetted moving filament 12 toward and into the surface of the soluble scintillator materials 30 by repositioning one or both of the guide pulleys 16, 44, or by displacing the soluble scintillator materials 30 along a shelf associated with the cutting zone 28 support, to allow the wetted moving filament 12 to cut into the cut, exposed surface of the soluble scintillator materials 30.

The cutting step cuts kerfs 32 into soluble scintillator materials 30 with the wetted moving filament 12, which moves in a forward F direction from supply pulley 14 toward takeup pulley 58, or is reciprocatingly reversed in direction to move in a reverse R direction toward supply pulley 14. The speeds of the wetted moving filament 12 are adjustable by an operator in the range commonly utilized by one skilled in the art for cutting scintillator materials. The width of kerf 32 cut is significantly less than the width of cuts made by prior art band saws. Kerf 32 cuts of about 0.7 mm to about 1.5 mm are possible, because the width of kerf 32 cut is nearly as thin as the filament 12 utilized, about 0.2 mm to about 1.0 mm width. During the engaging and cutting steps, the wetting step applies organic solvent liquid L to the moving filament 12 from the first dispensing dripper 24, when the filament is moving in the forward F direction, and/or applies alcohol based organic solvent liquid L or a different organic solvent 56, when the filament is moving in the reverse R direction. Dicing, slitting, and/or slotting steps can follow engaging and cutting steps, for segmenting scintillator materials into subunits having cut surfaces without the presence of water-induced hydrates.

The cutting step continues as the wetted moving filament 12 cuts through additional surfaces of the soluble scintillator materials 30, while the dissolving step occurs simultaneously with the cutting step, and the additional dicing step. The dissolving step includes the dissolving action of the organic solvent liquid L onto, and into the cut surfaces of the soluble scintillator materials 30. The dissolving action of the organic solvent liquid L, either alcohol-based or other organic-based solvent, softens each cut corner of each surface of the kerf 32, both at the entrance and exit openings of the kerf 32 (see FIGS. 3*a* and 3*b*), producing a gentle radiused corner of each edge 36 of each wall surface 34 of each kerf, and a gentle radiused corner 38 of each entrance and exit opening of the kerf 32. Utilization of organic solvent allows production of cut surfaces without the presence of water-induced hydrates. The gentle radiused corners 38 provide protection against cracking and breakage of scintillator materials 30 along any cut, exposed crystallographic plane due to the crystalline orientation of the scintillator materials 30. Sharp, jagged edges along corners can lead to cracking and breakage of scintillator material off of the corners of scintillator crystals, as allowed by the prior art cutters (see FIGS. 4*a* and 4*b*).

The additional benefits of the dissolving action of the organic solvent liquid L, with resulting softening of each cut corner of each surface of the kerf 32, is that even when a small corner piece or exit corner breaks away during the initial cutting and dicing steps of the disclosed method, and at final cut through of the scintillator materials, each of the broken edges will exhibit no sharp edges but will exhibit gently radiused corners 38. The gently radiused corners 38 thereby provide protection against cracking and breakage of soluble scintillator materials 30 whether the wetted moving filament 12 generates kerfs 32 that are cut partially through the soluble scintillator materials 30, or generates kerfs that are cut completely through the soluble scintillator materials 30. The consistent straight walls 34 and gently radiused corners 38 of the kerf 32 cuts (see FIGS. 3*a* and 3*b*) generated by the disclosed method of cutting and dicing are improved over the jagged, sharp corners created by the prior art mechanical sawing mechanisms (see FIGS. 4*a* and 4*b*).

A number of associated electrical and/or mechanical components known to those skilled in the art can be added to the disclosed method of cutting and dicing for ease of operation. A timer can electrically connect between a power drive source and the supply pulley 4 and/or takeup pulley 58, providing a signal for reciprocatingly reversing the direction of movement of the filament 12. A liquid-crystal display (LCD) can provide information to the operator on filament operating speed, the frequency of reversal of the direction of filament movement, and the rate of wetting of organic solvent liquid onto the filament. A drip pan 60 is placed under system 10 to catch liquid L released from the filament 12. One skilled in the art will recognize the mechanical components which support the method of operation are illustrated for clarity only. Other mechanical embodiments can be utilized without interfering with the objects and advantages of the present invention.

From the foregoing description, advantages will be recognized by those skilled in the art for the method for precision cutting of liquid soluble scintillator materials composed of NaI(TI). One advantage is that the method for cutting, dicing, slitting, slotting, and otherwise segmenting or pixellating soluble scintillator materials provides a kerf cut having organic solvent applied to the cut, exposed surfaces. The wetting of the exposed cut surfaces with organic solvents such as alcohol, largely eliminates the formation of hydrated scintillator cut surfaces and reduces the need for additional surface finishing to remove hydrate or to create a suitable finish. Therefore, liquid soluble scintillator materials prepared by the method for precision cutting are available in final form after the appropriate kerfs and segments are prepared by the disclosed method. Additionally, kerfs produced by the alcohol wetted moving filament creates one or a plurality of narrow, smooth kerfs having reproducible straight walls and having gently radiused corners for each edge of the kerfs. Accordingly, the gently radiused corners of the kerf cuts and diced soluble scintillator materials will withstand cracking, chipping, and fracturing along a cut, exposed crystallographic plane of the scintillator materials. The method for precision cutting provides scintillator materials having kerf cuts that are reproduced exactly from one group of scintillator materials to another group. Reproducibility of precise kerf cuts allow for production of scintillator materials having consistent responses to stimuli without signal degradation due to jagged and sharp cut corners.

A further advantage is that by providing a first run and a second run of the moving filament, with operator adjustable tensioning and operator adjustable speed of the moving filament, kerfs are produced with narrow width, smooth walls, and exit cuts that do not experience edge breakage at the final breakthrough of the moving filament through the liquid soluble scintillator materials. A further advantage is the combination of equipment utilized to accomplish the method of precision cutting with an alcohol wetted moving filament is not complex, is easily assembled, and easily repaired. The filaments utilized are of readily available materials providing adequate strength, and are easily replaceable if broken.

While a preferred embodiment is shown and described, it will be understood that it is not intended to limit the disclosure, but rather it is intended to cover all modifications and alternate methods falling within the spirit and the scope of the invention as defined in the appended claims. One skilled in the art will recognize variations and associated alternative embodiments. The foregoing description should not be limited to the description of the embodiment of the invention contained herein.

What is claimed is:

1. A method for precise cutting and dicing liquid soluble scintillator materials by an operator, including the steps of:

(a) providing a first run of a moving filament in operative proximity to cut into the liquid soluble scintillator materials;

(b) wetting at least said first run of said moving filament with an organic solvent which dissolves the cut liquid soluble scintillator materials along cut surfaces without the formation of surface hydrates; and (c) engaging the liquid soluble scintillator materials with said wetted first run for a time sufficient to cause said moving filament to create a kerf having cut surfaces, and to deliver said organic solvent onto said kerf cut surfaces; whereby liquid soluble scintillator materials contiguous to said kerf cut surfaces are dissolved to reshape said liquid soluble scintillator materials contiguous to said kerf cut surfaces.

2. The method of claim 1, wherein said method comprises the additional steps of:

(a) providing a second run of said moving filament, said second run in a reverse direction of said first run, said second run of said moving filament in operative proximity to the liquid soluble scintillator materials;

(b) tensioning said moving filament along said first run and along said second run, said tensioning step including variably adjusting tension on said moving filament during said wetting and engaging steps;

(c) wetting at least said second run of said moving filament with said organic solvent for the liquid soluble scintillator materials; and (d) positioning the liquid soluble scintillator materials during said wetted first run and said wetted second run for said time sufficient to cause said moving filament to continue creating said kerf having cut surfaces, and to continue delivering said organic solvent onto said kerf cut surfaces; whereby liquid soluble scintillator materials contiguous to said kerf cut surfaces are dissolved by said organic solvent to reshape said liquid soluble scintillator materials contiguous to said kerf cut surfaces.

3. The method of claim 2, wherein said method further comprises the additional steps of:

(a) cutting through the liquid soluble scintillator materials with said wetted moving filament, said wetted moving filament creating a kerf cut having cut surfaces through the liquid soluble scintillator materials during said wetted first run and said wetted second run, said wetted moving filament placing organic solvent along said cut surfaces of said kerf cut through the liquid soluble scintillator materials; and (b) dissolving the liquid soluble scintillator materials along the kerf, said dissolving step producing said kerf and kerf cut having straight walls of narrow width, and gently radiused corners.

4. The method of claim 3, wherein said method comprises the additional step of dicing the liquid soluble scintillator materials along said kerf cuts into separate subunits with said wetted moving filament, each separate subunit having straight walls and gently radiused corners.

5. The method of claim 4, wherein said engaging step further comprises reversing the direction of said moving filament at a frequency of reversing controlled by the operator.

6. The method of claim 5, wherein said tensioning step further comprises a step of adjusting tension variably on said first run and said second run of said moving filament during the steps of engaging, positioning, cutting, said dicing, said step of adjusting tension includes controlling tension variably by the operator on said moving filament.

7. The method of claim 6, wherein said wetting step further comprises dispensing alcohol or organic-based solvent on said first run and on said second run of said moving filament.

8. The method of claim 7, wherein said dissolving step further comprises the step of dispensing alcohol or organic-based solvent from said length of said moving wetted filament onto the kerf walls and corners, said dispensing step providing for softening of the kerf walls and corners, said softening providing gently radiused corners of the kerf.

9. The method of claim 8, wherein said engaging step further comprises the steps of:

(a) ganging said moving wetted filament together with a plurality of similar moving wetted filaments;

(b) orienting said plurality similar moving wetted filaments in generally crossing orientation;

(c) cutting the soluble scintillator materials with said plurality of moving wetted filaments; and (d) creating kerfs oriented in generally crossing orientation through the soluble scintillator materials.

10. The method of claim 9, wherein said engaging step further comprises the steps of:

(a) providing said moving wetted filament together with a plurality of similar moving wetted filaments;

(b) orienting said plurality of similar moving wetted filaments in generally parallel orientation;

(c) cutting the soluble scintillator materials with said plurality of moving wetted filaments; and (d) creating kerfs oriented in generally parallel orientation through the soluble scintillator materials.

11. An apparatus for the precision cutting and dicing of liquid soluble scintillator materials, said apparatus controlled by an operator, said apparatus comprising:

a filament, said filament moving along a first run length, the speed of said moving filament being controllable by the operator, said moving filament being positionable in close proximity to the liquid soluble scintillator materials;

at least one guide pulley, said at least one guide pulley in contact with said moving filament, said at least one guide pulley directs said moving filament along a first run in close proximity to the liquid soluble scintillator materials;

a tension pulley, said tension pulley in contact with said moving filament, said at least one tension pulley including a means for variably adjusting the tension of said moving filament;

a liquid dispenser, said liquid dispenser containing organic solvent and having an outlet positioned in close proximity to said moving filament, said liquid dispenser outlet dispenses organic solvent onto said moving filament along at least the first run length of said moving filament;

a means for engaging said wetted moving filament in contact with the liquid soluble scintillator materials, said engaging means being controllable by the operator;

a kerf cut into the liquid soluble scintillator materials by said wetted moving filament engaged in contact against the liquid soluble scintillator materials, said kerf cut having surfaces that receive organic solvent applied from the length of said wetted moving filament during contact against the liquid soluble scintillator materials, said kerf cut surfaces without the formation of surface hydrates; and a plurality of corners of said kerf cut, each of said plurality of corners having gently radiused corners, said gently radiused corners created by said organic solvent received on said surfaces of said kerf cut, said organic solvent dissolves into said surfaces of said kerf cut, said solvent softens said surfaces of said kerf cut to form gently radiused corners for each of said plurality of corners, said surfaces without the formation of surface hydrates.

12. The apparatus of claim 11, wherein said means for variably adjusting the tension of said wetted moving filament comprises a first tensioning pulley in contact with said wetted moving filament, said first tensioning pulley having a spring and a support weight to provide variable tension to said wetted moving filament, said variable tension provided by said first tensioning pulley is adjustable by the operator.

13. The apparatus of claim 12, wherein said wetted moving filament is intermittently reversed in direction of moving along a second run length of said filament, with the frequency of intermittently reversed direction of said wetted moving filament controllable by the operator.

14. A method for precision cutting and dicing liquid soluble scintillator materials by an operator, the method including the steps of:

(a) providing a first run of a moving filament in operative proximity to cut the liquid soluble scintillator materials;

(b) providing a second run of said moving filament, said second run in a reverse direction of said first run, said second run of said moving filament in operative proximity to cut the liquid soluble scintillator materials;

(c) tensioning said moving filament, said tensioning step including variably adjusting tension of said moving filament;

(d) wetting at least said first run and said second run of said moving filament with an organic solvent which dissolves the cut liquid soluble scintillator materials along the cut surface without the formation of surface hydrates;

(e) engaging said wetted first run and wetted second run for a time sufficient to cause said moving filament to create a kerf having cut surfaces, and to deliver said organic solvent onto said kerf cut surfaces and onto liquid soluble scintillator materials contiguous to said kerf cut surfaces;

(f) dissolving the kerf cut surfaces and contiguous liquid soluble scintillator materials with said organic solvent, softening said liquid soluble scintillator materials contiguous to said kerf cut surfaces, and forming kerfs having gently radiused corners; and (g) dicing the soluble scintillator materials into separate subunits with said wetted moving filament, each separate subunits having generally straight walls and gently radiused corners.

15. The method of claim 14, wherein said wetting step further comprises dispensing alcohol solvent or organic-based solvent along said wetted first run and said wetted second run of said moving filament.

* * * * *